US008955930B2

(12) United States Patent
Zehrer

(10) Patent No.: US 8,955,930 B2
(45) Date of Patent: Feb. 17, 2015

(54) ADJUSTABLE MODULAR TOOLBOX SYSTEM

(71) Applicant: Jeffrey John Zehrer, Sauk Centre, MN (US)

(72) Inventor: Jeffrey John Zehrer, Sauk Centre, MN (US)

( * ) Notice: Subject to any disclaimer, the term of this patent is extended or adjusted under 35 U.S.C. 154(b) by 0 days.

(21) Appl. No.: 13/684,218

(22) Filed: Nov. 22, 2012

(65) Prior Publication Data

US 2014/0139084 A1 May 22, 2014

(51) Int. Cl.
*A47B 88/00* (2006.01)
*B25H 3/02* (2006.01)

(52) U.S. Cl.
CPC ..... *B25H 3/02* (2013.01)
USPC ..... 312/351; 312/247; 312/334.11

(58) Field of Classification Search
CPC ..... A47B 88/044; A47B 2088/044; A47B 95/008; A47B 91/00; A47B 67/04; A47B 51/00
USPC ..... 312/245–247, 351, 317.1, 330.1, 334.4, 312/301, 321; 248/138–139, 423, 441.1, 248/225.11, 346.06, 316.4, 241, 221.11
See application file for complete search history.

(56) References Cited

U.S. PATENT DOCUMENTS 2,931,685 A * 4/1960 Butler ..... 312/196
4,917,430 A * 4/1990 Lawrence ..... 296/37.6
5,125,710 A * 6/1992 Gianelo ..... 296/37.1
5,378,057 A * 1/1995 Bach et al. ..... 312/257.1
5,481,431 A * 1/1996 Siahpolo et al. ..... 361/679.31
5,496,105 A * 3/1996 Czarnecky et al. ..... 312/334.4
5,571,256 A * 11/1996 Good et al. ..... 211/26
5,641,296 A * 6/1997 Larabell et al. ..... 439/342
5,785,402 A * 7/1998 DeLorenzo ..... 312/350
5,791,259 A * 8/1998 Mansfield et al. ..... 108/6
6,431,668 B1 * 8/2002 Reddicliffe ..... 312/334.5
6,619,772 B2 * 9/2003 Dierbeck ..... 312/334.13
6,659,576 B1 * 12/2003 Welch ..... 312/334.41
6,788,997 B1 * 9/2004 Frederick ..... 700/236
6,885,550 B1 * 4/2005 Williams ..... 361/679.33
7,440,273 B2 * 10/2008 Chen et al. ..... 361/679.33
8,456,831 B1 * 6/2013 Pang et al. ..... 361/679.33
2003/0094123 A1 * 5/2003 Ulmer ..... 108/10
2008/0315733 A1 * 12/2008 Bosch et al. ..... 312/223.3
2010/0026156 A1 * 2/2010 Leconte et al. ..... 312/408

* cited by examiner

*Primary Examiner* — Hanh V Tran

(57) ABSTRACT

A toolbox system is designed as with modular drawer unit with a mounting cradle that can adjust the height of the modular drawer unit, making it compatible to a wide variety of applications. The mounting cradle can be affixed from the top or bottom and can adjust the position of the modular drawer unit to various heights. The modular drawer units can be fabricated in different depths and stacked together for optimal space utilization. The toolbox system allows for placement so that the drawers pull out of a compartment or work space, allowing complete accessibility and space utilization. The mounting cradle can be designed so that the toolbox system can fit in almost any storage compartment or other desired spaces. The toolbox system allows for easy access to its compartments, especially in confined or limited spaces.

20 Claims, 8 Drawing Sheets

ADJUSTABLE MODULAR TOOLBOX SYSTEM

BACKGROUND OF THE INVENTION

The present invention relates to toolbox systems and, more particularly, to an adjustable, modular toolbox system designed for easy access in the storage compartment of commercial trucks, campers, and the like, with a mounting cradle.

Truckers, campers and similarly situated individuals do not have easy access to tools typically stored in storage compartments. These individuals typically store their tools in totes or portable toolboxes that must be removed or manipulated to access the tools within.

Traditional toolboxes do not include any method to adjust to the varying measurements of different storage compartments, work spaces or other applications. Typical toolboxes do not organize or utilize the limited spaces of ordinary storage compartments.

As can be seen, there is a need for an improved toolbox system that can be adjustable and modular so as to provide easy access to the storage compartment of commercial trucks, campers and the like.

SUMMARY OF THE INVENTION

In one aspect of the present invention, a toolbox system comprises a cradle having a base member and a plurality of arms extending therefrom; a plurality of slots cut into each arm; a base drawer member adapted to fit between the arms of the cradle; a plurality of fastener holes disposed on sides of the base drawer member; and a plurality of fasteners adapted to fit into one of the plurality of slots cut into each arm and extend into one of the plurality of fastener holes.

In another aspect of the present invention, a toolbox system comprises a cradle having a base member and at least four arms, extending from the base member with at least two arms on each side thereof; a plurality of mounting holes disposed in the base member for attaching the cradle to a floor or ceiling of a compartment; a plurality of slots cut into each arm; a base drawer member adapted to fit between the arms of the cradle; at least two fastener holes disposed on each side of the base drawer member; and a plurality of fasteners adapted to fit into one of the plurality of slots cut into each arm and extend into one of the plurality of fastener holes.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a toolbox system designed as with modular drawer unit with a mounting cradle that can adjust the height of the modular drawer unit, making it compatible to a wide variety of applications. The mounting cradle can be affixed from the top or bottom and can adjust the position of the modular drawer unit to various heights. The modular drawer units can be fabricated in different depths and stacked together for optimal space utilization. The toolbox system allows for placement so that the drawers pull out of a compartment or work space, allowing complete accessibility and space utilization. The mounting cradle can be designed so that the toolbox system can fit in almost any storage compartment or other desired spaces. The toolbox system allows for easy access to its compartments, especially in confined or limited spaces.

Figure 1:
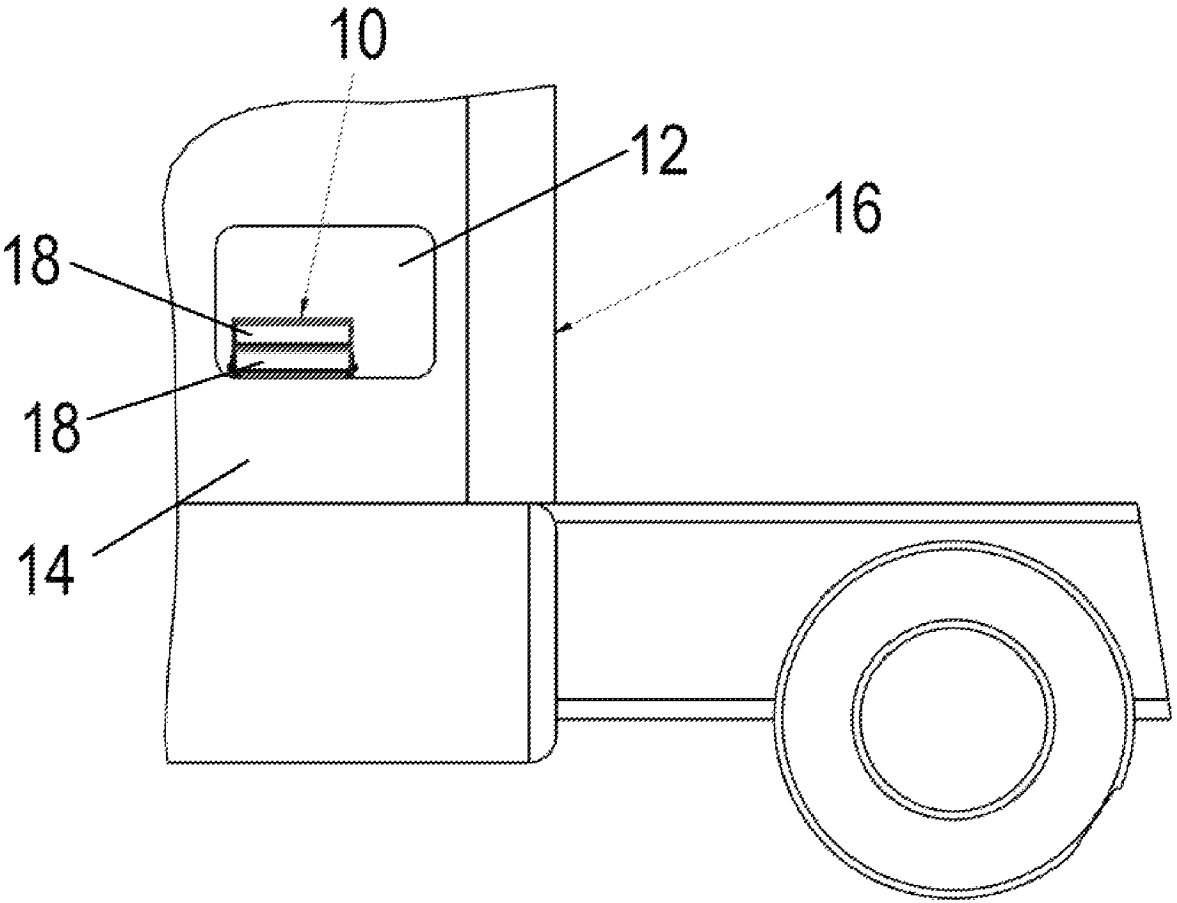
FIG. 1 is a perspective view of a toolbox system, installed in a truck cubby, according to an exemplary embodiment of the present invention.

Referring to FIG. 1, a toolbox system 10 can fit into a compartment 12 in, for example, a body 14 a vehicle, such as a truck 16. As described in greater detail below, the toolbox system can be positioned at a desired height so that drawers 18 of the toolbox system 10 can be pulled out to an exterior of the compartment 12.

Figure 2:
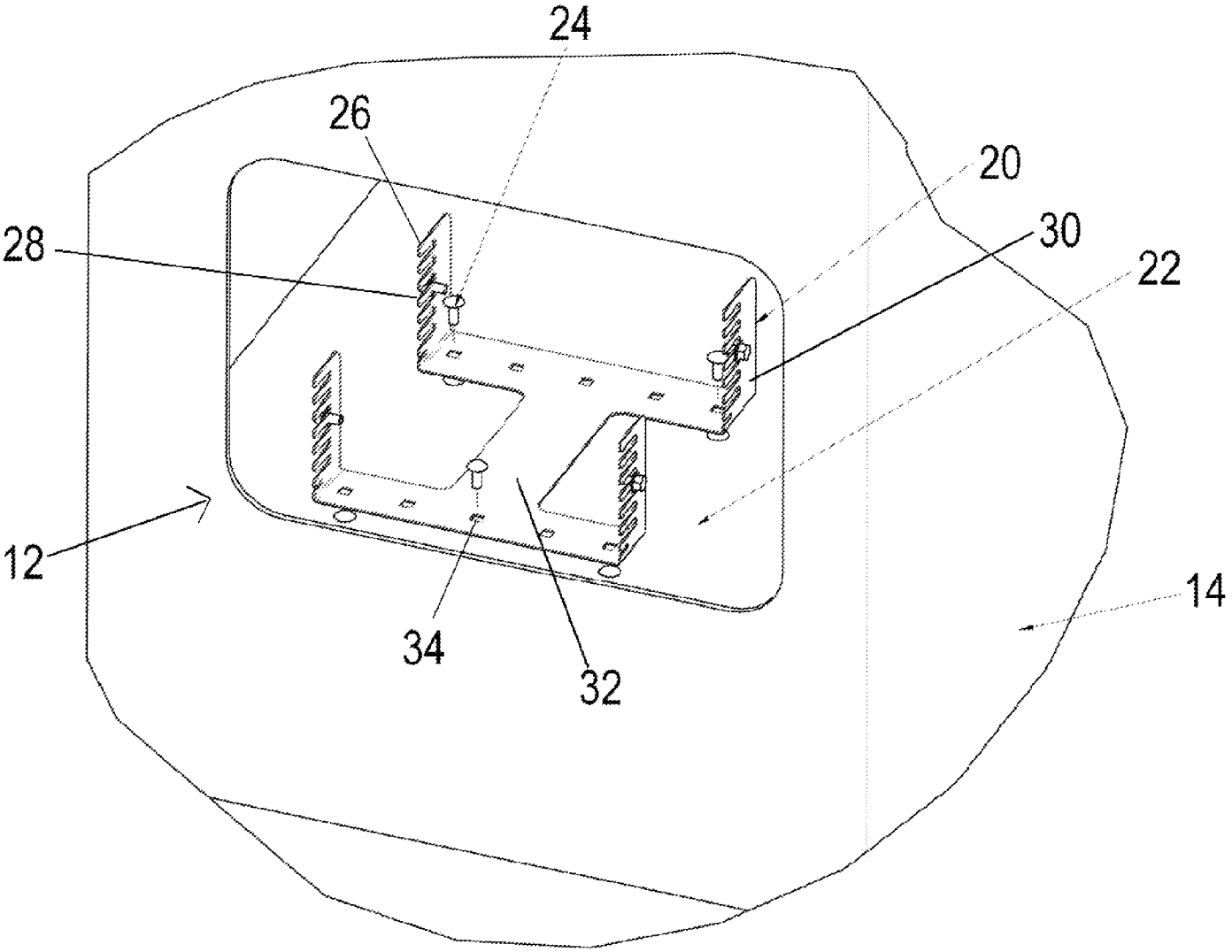
FIG. 2 is a perspective view of a cradle member of the toolbox system of FIG. 1.
Figure 3:
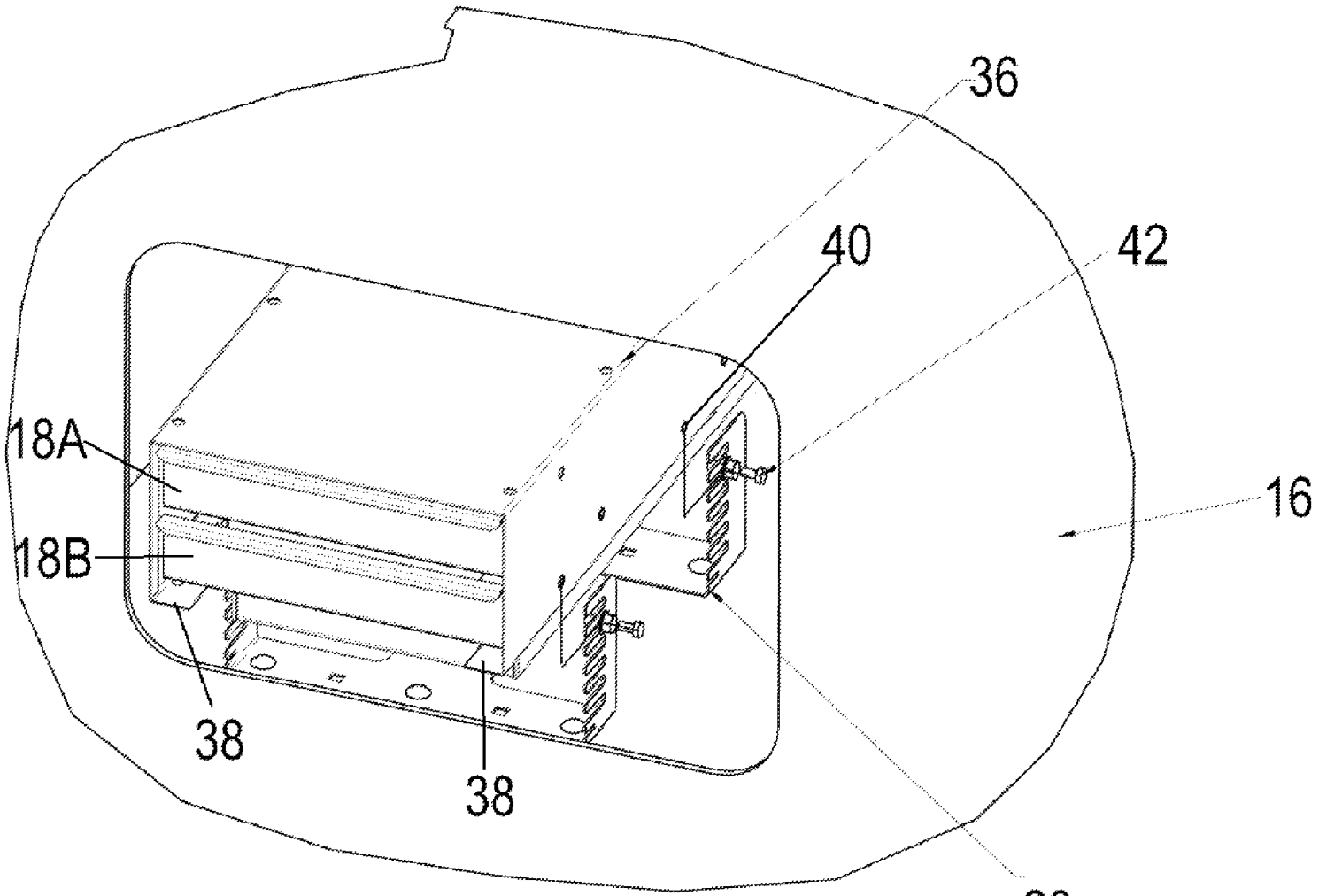
FIG. 3 is a perspective view showing base drawer members installed in the cradle member of FIG. 2, illustrating selecting a particular slot to allow the lower drawer member to open beyond a cubby opening.
Figure 4:
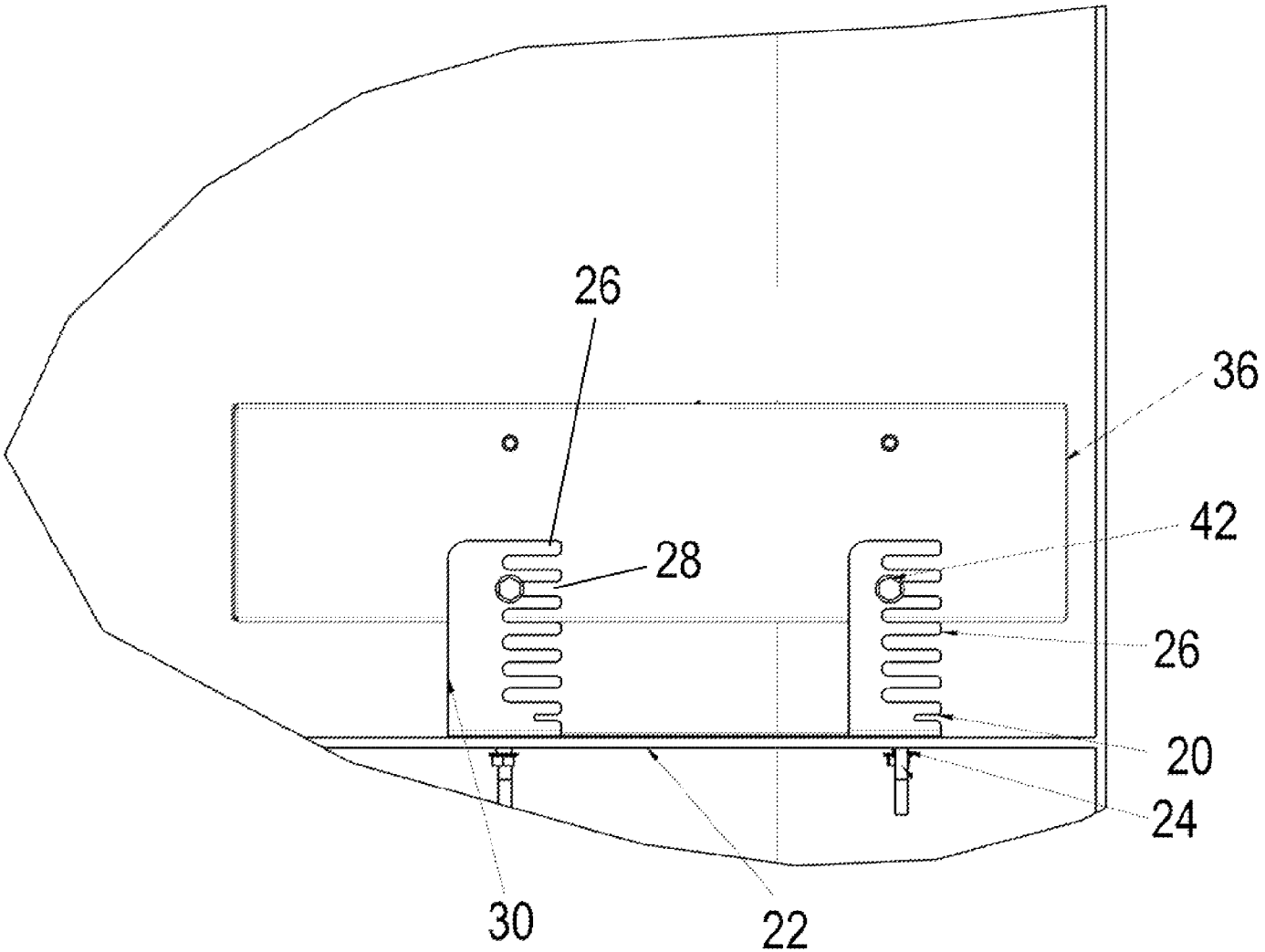
FIG. 4 is a side view of the base drawer members of FIG. 3 installed in the cradle member of FIG. 2.

Referring now also to FIGS. 2 through 4, the toolbox system 10 can include a cradle 20 that can be attached inside the compartment 12, such as on a floor 22 of the compartment 12. Various attachment means, such as carriage bolts 24, can be used to secure the cradle 20 inside the compartment 12. While FIG. 2 through 4 show the cradle 20 on the floor 22 of the compartment 12, the cradle can be disposed on a ceiling of the compartment 12, if desired for space utilization or user preference.

The cradle 20 can be made from various materials, such as 20 gauge galvanized steel, for example. The cradle 20 can be formed in an H-shape, with a base member 32, adapted to fit against the floor 22 of the compartment 12, and arms 30 of the H-shape bent about 90 degrees from the base member 32 to extend away from the floor 22 of the compartment 12. The base member can include a plurality of holes 34 for insertion of the bolts 24 therethrough. The arms 30 can be formed in various lengths, usually from about 2 to about 5 inches long, typically about 3 inches long.

The arms 30 of the cradle 20 can have a plurality of slots 28 cut therein, between adjacent fingers 26. The slots 28 on each of the arms 30 can be identical in spacing, height and depth. In some embodiments, the front and backs of each slot 28 can be rounded, but angled cuts can work as well.

The cradle 20 can be formed in various sizes. Typically the mounting cradle 20 can be about 11 inches wide and about 12 inches, front to back. Of course, other dimensions can be used, depending on the side of the compartment 12 and the user preferences.

The shape of the cradle 20 can vary. In some embodiments, the cradle can be made in an X-shape or U-shape, for example.

A base drawer module 36 can have a width to fit between the arms 30 of the cradle 20. The base drawer module 36 can be made of various materials, such as galvanized steel, aluminum, or the like. The depth of the drawer base module 36 can vary with the depth of the compartment 12. Typical depths for the drawer base module 36 can be, for example, 18, 20, 24, or 30 inches. The base drawer module 36 can include, for example, two drawers 18 disposed one on top of the other. In some embodiments, the base drawer module 36 can include more or fewer drawers. The height of the drawers 18 can be as little as about 2 inches, but can be as high as 8 inches. In one exemplary embodiment, the base drawer module 36 can include two drawers, a lower drawer 18B and an upper drawer 18A. The lower drawer 18B can be from 3 inches to 5.5 inches, in height, for example, and the upper drawer 18A can be, for example, 2 to 4 inches in height. Therefore the base drawer module 36 can vary in height, from about 5 inches to about 10 inches, depending upon the height of the drawers within.

The base drawer module 36 can be fabricated by various techniques, such as be welding, screwing, gluing, riveting or the like. Typically, a bottom portion of the base drawer module 36 can be open with about 1.25 inches overlap on the sides and about 0.5 inch overlap on the back. In some embodiments, a 1.75-inch stabilizing brace can be affixed between the two side overlaps 38. The overlaps 38 can include keyhole cuts (as described below), allowing the base drawer module 36 to be used as an add-on module, as discussed in greater detail below.

Figure 8:
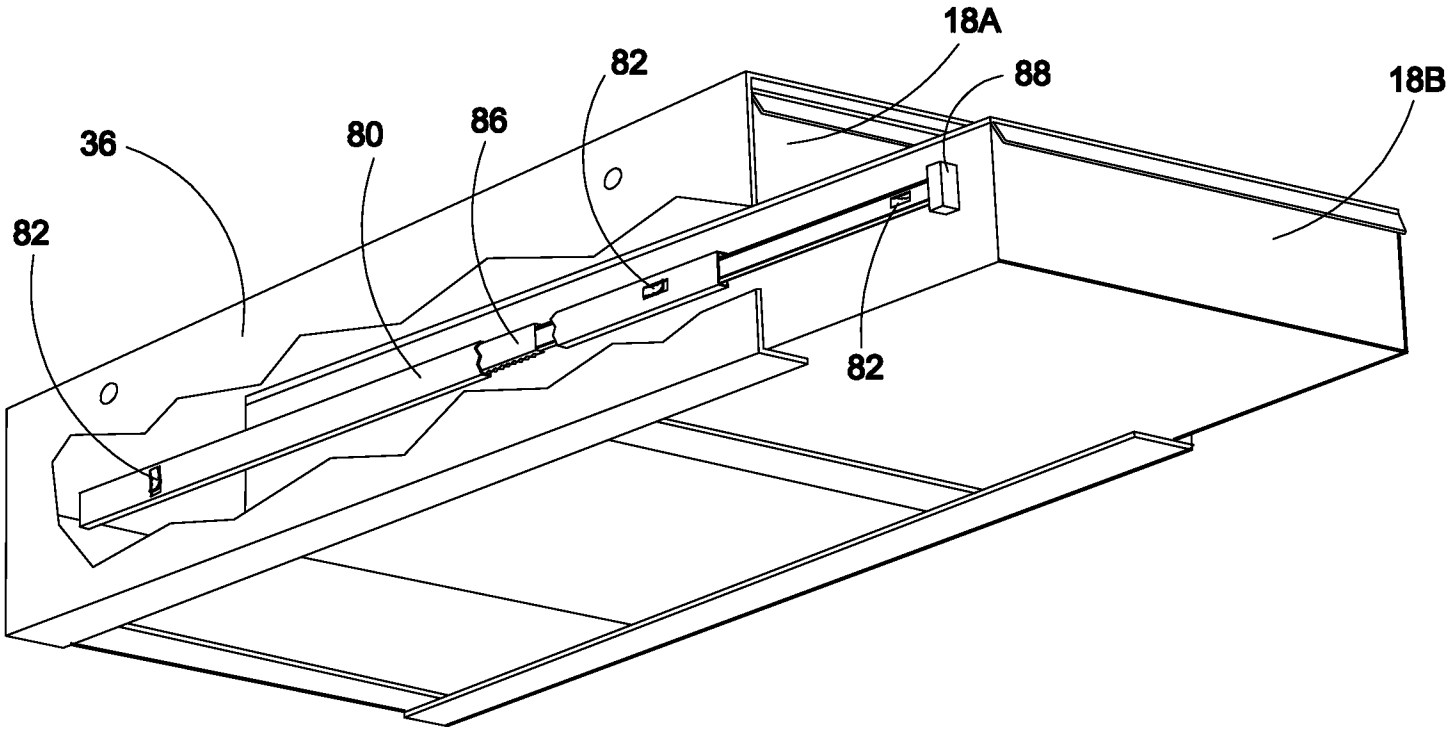
FIG. 8 is a cutaway perspective view of the base drawer module of the FIG. 1, showing the drawer slides that couple the drawers to the base drawer module.

The drawers 18A, 18B can attach to the base drawer module 36 by various methods, such as by drawer slides 80, for example. As shown in FIG. 8, the drawer slides can be for example, bayonet-style slides (comprising bayonet mounts 82) suitable for 60-100 pound test strength and can use ball bearings 86 and can include a stay-closed mechanism 88. The drawer slides 80 can permit the drawers to extend nearly 100%. Of course, other drawer slide configurations can be used. The drawers can be lined with various materials, such as a chemical resistant foam, rubber, cloth, or the like.

The drawers can have various designs and can be manufactured from various materials. For example, the drawers can be made of stainless steel, galvanized steel, powder-coated steel or the like. In some embodiments, the drawer faces can include handles that can serve as draw pulls as well as a locking mechanism to secure the drawers in a closed position, as is known in the art.

Fastening holes 40 can be disposed, at least two in each side, in the base drawer module 36. A fastener 42 can be disposed in the fastening holes 40 while supporting the base drawer module 36 within the slots 28 of the arms 30 of the cradle 20. By selecting the proper slots 28, the base drawer module 36 can be disposed at the proper height to permit the drawers 18 (especially the lower drawer 18B) to be extended out of the compartment 12.

Figure 5:
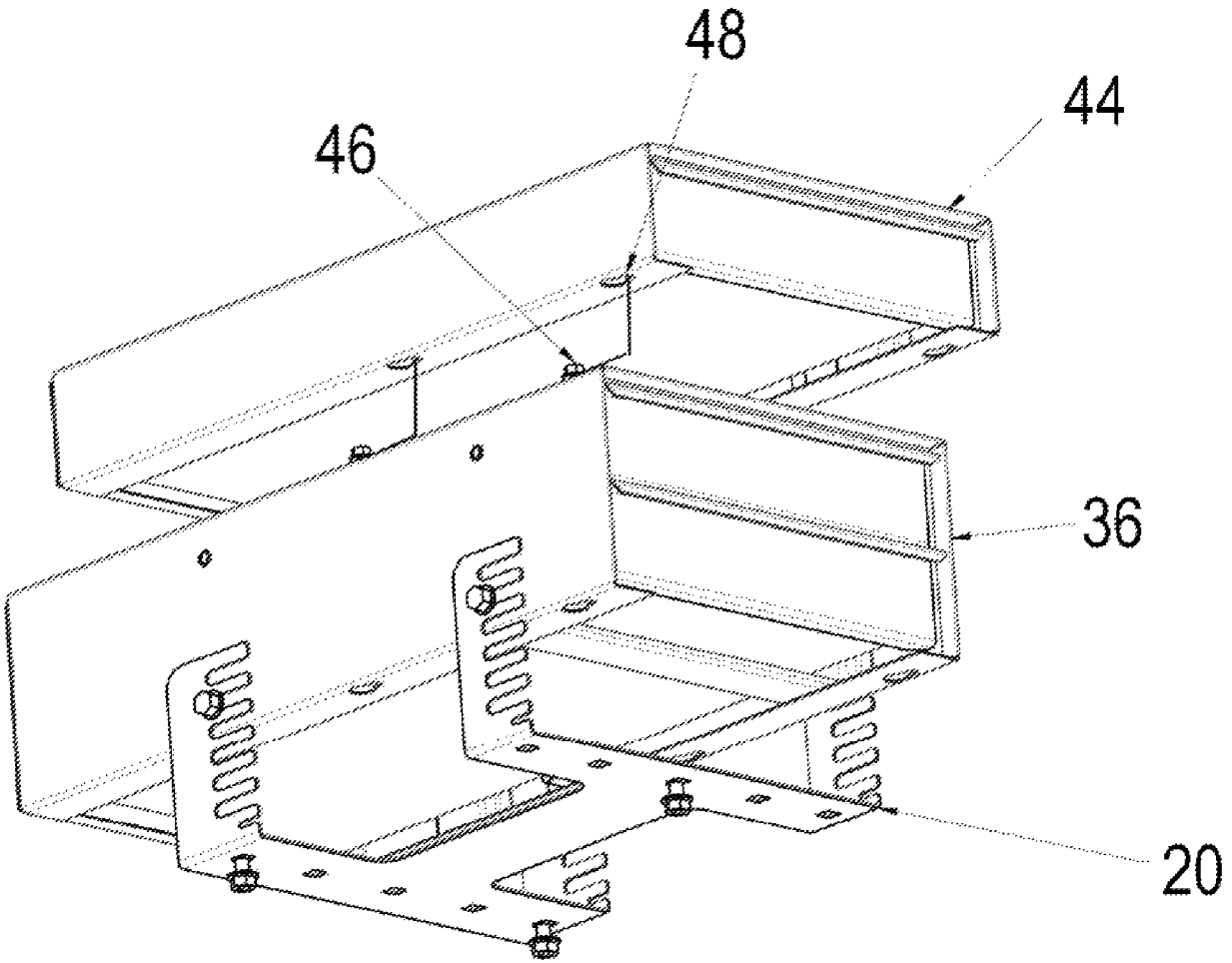
FIG. 5 is a perspective view showing the toolbox system removed from the truck cubby, illustrating the modular addition of an add-on drawer to the base drawer members of FIG. 3.

Referring now to FIG. 5, one or more drawer add-on modules 44 can be added on top (or on bottom, in a ceiling mount configuration) of the base drawer module 36. The drawer add-on modules 44 can include a plurality of keyhole slots 48, typically two on each side, disposed on a bottom member thereof. A plurality of fasteners 46, corresponding to the number of keyhole slots 48 can be positioned to extend from a top surface 50 of the base drawer module 36. The fasteners 46 can be positioned to allow the keyhole slots 48 to fit over and engage therewith. The fasteners 46 can then be tightened to secure the drawer add-on module 44 to the base drawer module 36. Various drawer sizes can be used in the drawer add-on module 44, however, typically, the drawer add-on module 44 has the same width as the base drawer module 36.

Multiple drawer add-on modules 44 can be stacked on top of each other, as the top surface of a drawer add-on module 44 can permit fasteners 46 to extend therefrom to permit the keyhole slots 48 of another drawer add-on module 44 to fit thereupon. The base drawer module 36, as described above, can also be used as an add-on module. In other words, two of the base drawer modules 36 can be stacked and connected together if desired, with one of the base drawer modules 36 attached to the cradle 20 and the other attached on top (or below, in a ceiling mount configuration) the base drawer module 36.

Figure 6:
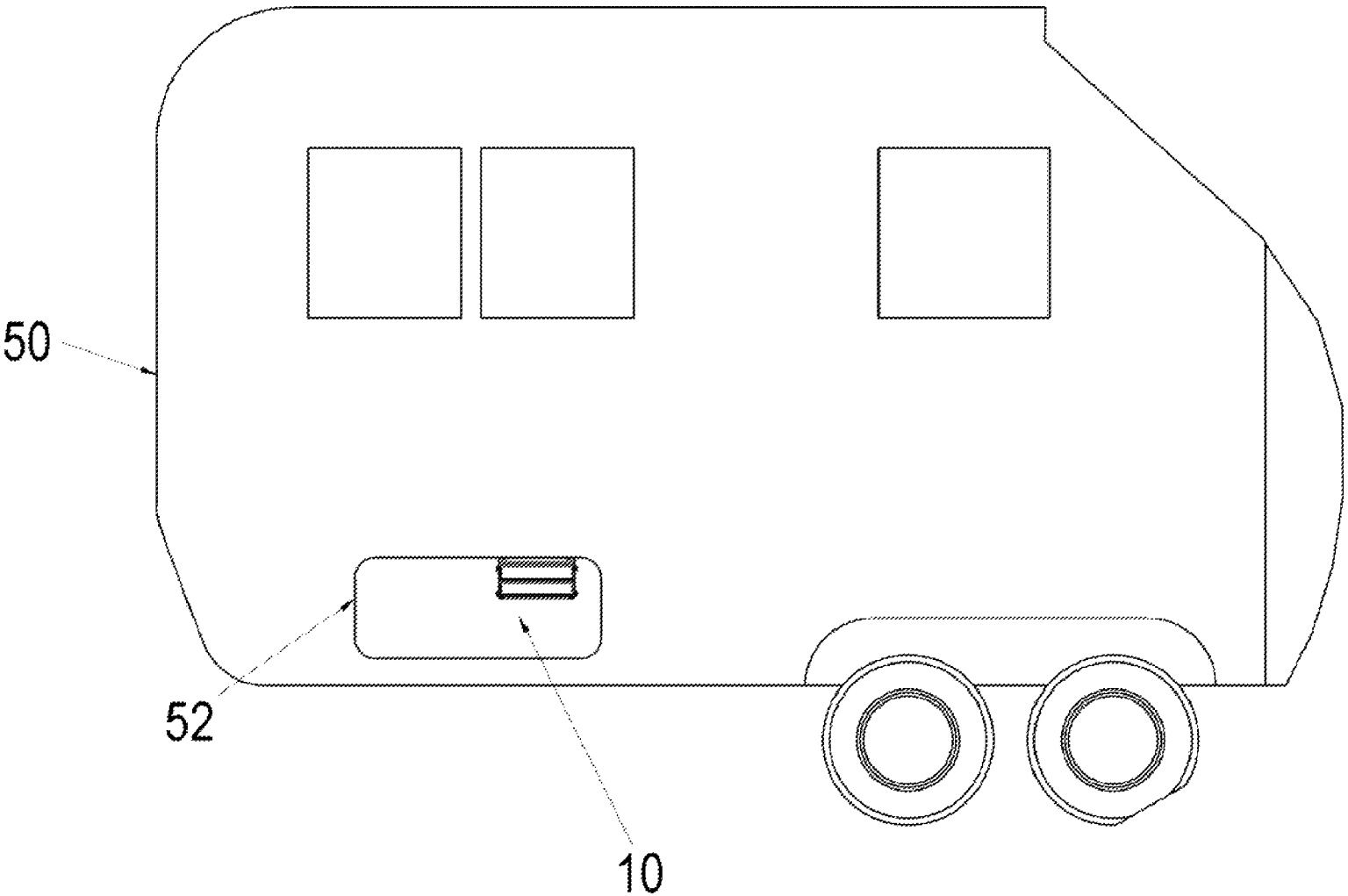
FIG. 6 is a side view of a camper having the toolbox system of FIG. 1 disposed from a ceiling of a compartment.
Figure 7:
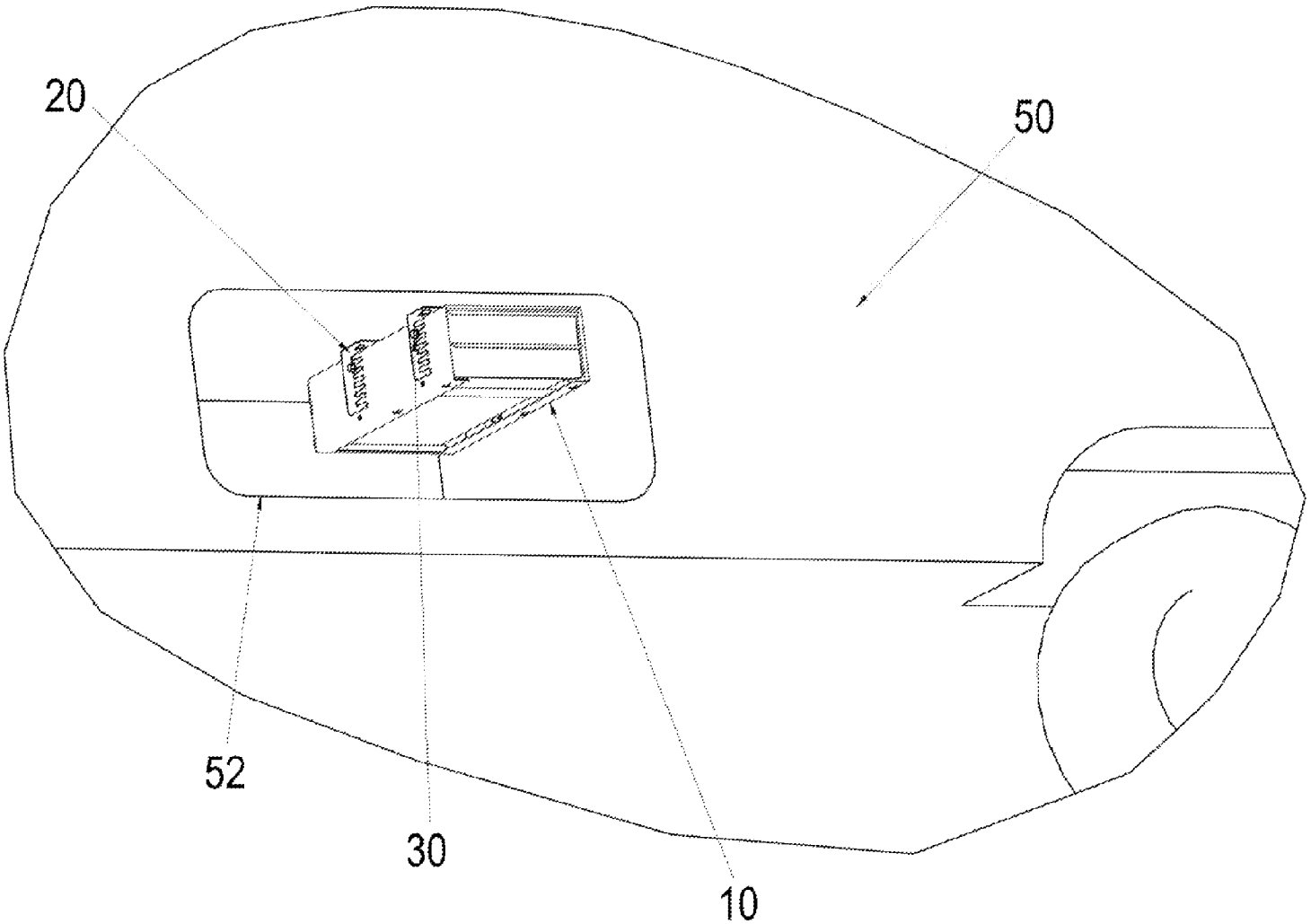
FIG. 7 is a detailed perspective view of the camper with the toolbox system, as shown in FIG. 6.

Referring now to FIGS. 6 and 7, a camper 50 can include a compartment 52 in which the toolbox system 10 can be disposed. In this embodiment, the cradle 20 can be mounted on a ceiling surface 54 of the compartment 52.

The toolbox system of the present invention can be installed in various locations, including in the under-bunk storage compartment of a commercial truck, camper storage compartments, atop or under work benches, in storage or race trailers, in vans and SUV's, in shops or any other storage units or areas where typical toolboxes are traditionally stored or necessary.

The toolbox system of the present invention can be used in any indoor or enclosed space to store any number of items in addition to tools, such as jewelry, office supplies, crafts, media materials and the like.

It should be understood, of course, that the foregoing relates to exemplary embodiments of the invention and that modifications may be made without departing from the spirit and scope of the invention as set forth in the following claims.

What is claimed is:

1. A drawer system for a truck or camper storage compartment, comprising:

a cradle having a base member configured to couple to a surface of the storage compartment and a plurality of arms extending therefrom;

a plurality of slots cut into each arm at incremental distances from the base member;

a drawer enclosure that fits between the arms of the cradle, the drawer enclosure comprises a top, a bottom and two sides;

at least one drawer slidingly coupled to the drawer enclosure by drawer slides that is substantially contained within the drawer enclosure in a closed position and extended from the drawer enclosure in an open position;

a plurality of fastener holes disposed on the sides of the drawer enclosure; and a plurality of fasteners that each extend into one of the plurality of fastener holes and secure the drawer enclosure to the cradle by engaging a respective slot of the plurality of slots;

the drawer enclosure being mountable at various distances from the base member depending on which slots to which it is secured.

2. The system of claim 1, wherein the base member has an H-shape with one of the plurality of arms extending from each end of the H-shape.

3. The system of claim 1, further comprising a plurality of mounting holes disposed in the base member for attaching the cradle to a floor or ceiling of the storage compartment.

4. The system of claim 1, wherein the drawer enclosure includes from one to three drawers.

5. The system of claim 1, further comprising an add-on drawer enclosure that attaches to a surface opposite the bottom of the drawer enclosure or other add-on drawer enclosures;

the add-on drawer enclosure having at least one drawer slidingly coupled thereto by drawer slides that is substantially contained within the add-on drawer enclosure in a closed position and extended from the add-on drawer enclosure in an open position.

6. The system of claim 5, wherein a portion of the add-on drawer enclosure that attaches to the drawer enclosure of other add-on drawer enclosures includes a plurality of keyhole slots.

7. The system of claim 6, wherein the surface opposite the bottom of the drawer enclosure includes a plurality of add-on fasteners that fit into and secure to the keyhole slots to secure the add-on drawer enclosure to the drawer enclosure.

8. The system of claim 1, wherein the plurality of slots are disposed at a height sufficient to permit drawers of the drawer enclosure to fully open and extend outside of the storage compartment in which the cradle is disposed.

9. The system of claim 1, wherein the drawer slides are bayonet-style slides.

10. The system of claim 1, wherein the drawer slides comprise ball bearings.

11. The system of claim 1, wherein the drawer slides comprise a stay-closed mechanism that retains the drawers in a closed position.

12. A truck or camper storage compartment drawer system, comprising:

a truck or camper storage compartment;

a cradle having a base member that couples to a surface of the storage compartment and a plurality of arms, extending therefrom;

a plurality of slots cut into each arm at incremental distances from the base member;

a drawer enclosure that fits between the arms of the cradle, the drawer enclosure comprising a top, a bottom and two sides;

at least one drawer slidingly coupled to the drawer enclosure by drawer slides that is substantially contained within the drawer enclosure in a closed position and extended from the drawer enclosure in an open position;

a plurality of fastener holes on the sides of the drawer enclosure; and a plurality of fasteners that each extend into one of the plurality of fastener holes and secure the drawer enclosure to the cradle by engaging a respective slot of the plurality of slots;

the drawer enclosure being mountable at various distances from the floor or ceiling of the storage compartment depending on which slots to which it is secured.

13. The system of claim 12, wherein the base member has an H-shape with one of the plurality of arms extending from each end of the H-shape.

14. The system of claim 12, wherein the drawer enclosure includes from one to three drawers.

15. The system of claim 12, further comprising an add-on drawer enclosure that attaches to a surface opposite the bottom of the drawer enclosure or other add-on drawer enclosure.

16. The system of claim 15, wherein a portion of the add-on drawer enclosure that attaches to the drawer enclosure or other add-on drawer enclosures includes a plurality of keyhole slots.

17. The system of claim 16, wherein the surface of the drawer enclosure opposite the bottom includes a plurality of add-on fasteners that fit into and secure to the keyhole slots to secure the add-on drawer enclsoure to the drawer enclosure.

18. The system of claim 15, wherein a surface of the add-on drawer enclosure opposite a bottom of the add-on drawer enclosure includes a plurality of add-on fasteners that fit into and secure to keyhole slots of a second add-on drawer enclosure.

19. The system of claim 12, wherein the drawer slides are bayonet-style slides.

20. The system of claim 12, wherein the drawer slides comprise ball bearings.

* * * * *